US009264821B2

(12) United States Patent
Thiede et al.

(10) Patent No.: US 9,264,821 B2
(45) Date of Patent: Feb. 16, 2016

(54) HEARING AID SYSTEM WITH LOST PARTNER FUNCTIONALITY

(75) Inventors: Thilo Volker Thiede, Copenhagen (DK); Peter Magnus Norgaard, Vanlose (DK)

(73) Assignee: WIDEX A/S, Lynge (DE)

( * ) Notice: Subject to any disclaimer, the term of this patent is extended or adjusted under 35 U.S.C. 154(b) by 193 days.

(21) Appl. No.: 13/446,496

(22) Filed: Apr. 13, 2012

(65) Prior Publication Data

US 2012/0195449 A1 Aug. 2, 2012

Related U.S. Application Data

(63) Continuation-in-part of application No. PCT/EP2009/063663, filed on Oct. 19, 2009.

(51) Int. Cl.
*H04R 25/00* (2006.01)

(52) U.S. Cl.
CPC ..... *H04R 25/305* (2013.01); *H04R 25/556* (2013.01); *H04R 25/558* (2013.01); *H04R 25/55* (2013.01); *H04R 25/552* (2013.01); *H04R 25/554* (2013.01)

(58) Field of Classification Search
CPC .... H04R 25/55; H04R 25/552; H04R 25/554; H04R 25/556; H04R 25/558; H04R 25/305
USPC ..... 455/41.2; 381/315
See application file for complete search history.

(56) References Cited

U.S. PATENT DOCUMENTS

| | | | | |
|---|---|---|---|---|
| 6,600,971 | B1 * | 7/2003 | Smith | G05B 15/02 700/17 |
| 8,189,835 | B2 * | 5/2012 | Dietz | H04R 25/554 381/312 |
| 8,306,478 | B2 * | 11/2012 | Gross | 455/67.11 |
| 2003/0096576 | A1 * | 5/2003 | Salonidis et al. | 455/41 |
| 2005/0238190 | A1 | 10/2005 | Rohrlein | |
| 2006/0250219 | A1 * | 11/2006 | Hui | 340/10.1 |
| 2007/0030988 | A1 * | 2/2007 | Bauml | H04R 25/558 381/315 |
| 2007/0058588 | A1 * | 3/2007 | Fashandi et al. | 370/331 |

(Continued)

FOREIGN PATENT DOCUMENTS

| | | | |
|---|---|---|---|
| DE | 102007039455 | A1 | 2/2009 |
| DE | 102007046437 | A1 | 4/2009 |

(Continued)

OTHER PUBLICATIONS

International Search Report for PCT/EP2009/063663 dated Feb. 17, 2011.

(Continued)

*Primary Examiner* — Duc Nguyen
*Assistant Examiner* — Sean H Nguyen
(74) *Attorney, Agent, or Firm* — Sughrue Mion, PLLC

(57) ABSTRACT

A hearing aid system includes a first (1) and a second (11) hearing aid, each having link means for establishing a short-range wireless connection (20) between the first and the second hearing aid. At least the first hearing aid has means to monitor whether the link to the second hearing aid is active and alert means to issue an alert based on a condition of the link or on a condition of the second hearing aid. The alert can be a spoken message, a visual indicator, or a message sent to an external unit (30). The invention further provides a method to issue an alarm in a first hearing aid.

10 Claims, 2 Drawing Sheets

(56) References Cited

U.S. PATENT DOCUMENTS

| | | | | |
|---|---|---|---|---|
| 2008/0070495 | A1* | 3/2008 | Stricklen et al. | 455/3.01 |
| 2009/0052707 | A1 | 2/2009 | Hain | |
| 2009/0087005 | A1 | 4/2009 | Reithinger | |
| 2009/0231125 | A1* | 9/2009 | Baldus | A61B 5/0006 340/539.12 |
| 2009/0262948 | A1* | 10/2009 | Hasler et al. | 381/60 |

FOREIGN PATENT DOCUMENTS

| | | | | |
|---|---|---|---|---|
| EP | 1276349 | B1 | 9/2004 | |
| WO | 2006074655 | * | 7/2006 | H04R 25/00 |
| WO | 2006074655 | A1 | 7/2006 | |
| WO | 2007144010 | * | 12/2007 | H04R 25/00 |
| WO | 2007144010 | A1 | 12/2007 | |
| WO | 2009006889 | A1 | 1/2009 | |
| WO | 2009063097 | A2 | 5/2009 | |

OTHER PUBLICATIONS

"Baseband Specification—Link Manager Protocol—Host Controller Interface Functional Specification" Bluetooth Specification Version, No. VERS. 2.0 EDR (vol. 3) Nov. 4, 2004, XP002396499 p. 95, lines 16-32.

* cited by examiner

HEARING AID SYSTEM WITH LOST PARTNER FUNCTIONALITY

RELATED APPLICATIONS

The present application is a continuation-in-part of application PCT/EP2009063663, filed on Oct. 19, 2009, in Europe and published as WO2011047707 A1.

BACKGROUND OF THE INVENTION

1. Field of the Invention

The present invention relates to hearing aids. The invention, more particularly relates to hearing aids with a wireless link to transmit and receive data. The invention still more particularly relates to binaural systems, i.e. systems including a pair of hearing aids for aiding both ears. The invention further relates to a method of monitoring the operation of a hearing aid.

A hearing aid is here understood to be an electronic device, for helping the hard of hearing, including an input transducer for receiving an acoustic input signal and convert said input signal into an electrical signal, a signal processing unit for amplifying the signal according to the user's needs and an output transducer for converting the electrical signal into an acoustic output signal. The hearing aid can be any type of hearing aid e.g. In-The-Ear (ITE), Completely-In-the-Canal (CiC), Behind-The-Ear (BTE) or hybrids thereof.

2. The Prior Art

DE 102007039455 A1 shows a hearing aid system, where each hearing aid in a pair includes a magnetic field sensor and a wireless connection between the two hearing aids. If the magnetic field sensor in one hearing aid detects an increased magnetic field without the contralateral hearing aid detecting the same magnetic field, this is interpreted as being due to the magnetic field from a telephone, and the hearing aids adjust accordingly. If both hearing aids detect a magnetic field of the same strength, this is interpreted as being due to both hearing aids residing in the hearing aid battery charger, and both hearing aids will automatically deactivate.

Similarly DE 102007046437 A1 describes a hearing aid system with two hearing aids being wirelessly connected to each other. If the two hearing aids are placed in a storage box in close proximity of each other, the field strength of the wireless connection will increase due to the decrease in distance, and the both hearing aids will power down or go in to sleep mode.

US 20050238190 A1 describes a hearing aid with a proximity sensor. Said proximity sensor detects whether a hand is in proximity of the hearing aid, and based on the signal from said proximity sensor, the hearing aid may change program or turn the volume up or down.

WO 2009006889 A1 describes a hearing aid with means for identifying the transducers in said hearing aid by measuring the impedance of said transducers.

EP 1276349 B1 describes a way for the hearing aid to test parts of the electronics or the full function of the hearing aid, to establish which parts need service.

SUMMARY OF THE INVENTION

Modern hearing aids are so light and comfortable to wear, that the user might not notice wearing them. Consequently, if a hearing aid falls off its position at or in the ear, the user might not notice loosing one of the hearing aids. It is a feature of the invention to better monitor the placement of the hearing aids.

The present invention aims at providing a failure detection and notification system for detecting defective or missing parts of a hearing aid system and especially for informing the user of said hearing aid system of such errors.

The invention, in a first aspect, provides a hearing aid system including a first and a second hearing aid, each having link means for establishing a short-range wireless connection between the first and the second hearing aid, where at least the first hearing aid has means to monitor whether the link to the second hearing aid is active and alert means to issue an alert based on a condition of the link or on a condition of the second hearing aid.

With wireless inter-ear connection i.e. connection between the users left and right hearing aid, the wireless connection can be used to control whether the contralateral hearing aid is located at or in the opposite ear and if not, give an alarm to the user that he might have lost his left or right hearing aid, or it is not operating. The wireless inter-ear connection is normally designed with a short range, e.g. no more than 0.5 m, sufficient for communication while the hearing aids are located at the respective ears. If a hearing aid is moved out of range, the connection is lost.

By periodically communicating with the contralateral hearing aid through the wireless link while constantly monitoring the traffic received, it can be verified whether an active connection to the opposite hearing aid exists. If the connection is lost for a longer period of time, it is likely that one of the following situations has occurred. Either the battery of the opposite hearing aid is flat and there is no transmission from the contralateral hearing aid, or the opposite hearing aid is located too far away for the wireless link to be able to keep an active wireless connection with the contralateral hearing aid. When the system has detected a loss of wireless connection to the second hearing aid over a predetermined period of time, for example 10 seconds, both hearing aids will alert the user to check the status of the opposite hearing aid. The right hearing aid will tell the user to check the status of the left hearing aid and vice versa. As one of the hearing aids is either turned off because of a flat battery or is not located within reach of the wireless link and thereby not located at the correct position at or in the ear of the user, the user will only hear the message in one ear and hereby be alerted that he or she has lost the hearing aid at the opposite ear, or that the battery of the opposite hearing aid is flat.

The invention, in a second aspect, provides a method of issuing an alarm in a first hearing aid, comprising establishing a link for short range wireless connection between the first and a second hearing aid, monitoring whether the link to the second hearing aid is active and issuing an alarm based on a condition of the link or on a condition of the second hearing aid.

In order to ensure that the user will not receive an alarm for no connection between the two hearing aids before the wireless link has been able to initially establish this connection after turning on the hearing aids, the system must preferably log an active connection for some period of time before initiating the monitoring of whether the wireless link is active.

Further aspects of the invention appear from the subclaims.

BRIEF DESCRIPTION OF THE DRAWINGS

The invention will now be described in greater detail based on preferred embodiments and the drawings, wherein.

DETAILED DESCRIPTION OF THE INVENTION

After power-up of either one of the hearing aids, it will start looking for its 'partner' on the wireless link, attempting to establish a connection to the opposite hearing aid. Once the connection has been established between the two hearing aids, a first counter will start, in order to log the time the connection has been active. If the connection is broken, after it has been confirmed that there has been logged a stable connection for a predetermined length of time, a second countdown will initiate. If the wireless connection is reestablished before the second counter reaches a predetermined count, the first counter will reset and start over, and monitor whether there is a stable connection. If the wireless connection is not reestablished before the second counter reaches its predetermined count, this will trigger an alarm. The alarm may be given in several different ways. It could be a spoken message given by the hearing aid to the user, it could be turning on or flashing an LED on the hearing aid, or it could be an alarm sent to a remote control, or another external unit convenient for alerting the user, a relative or an attendant.

Figure 1:
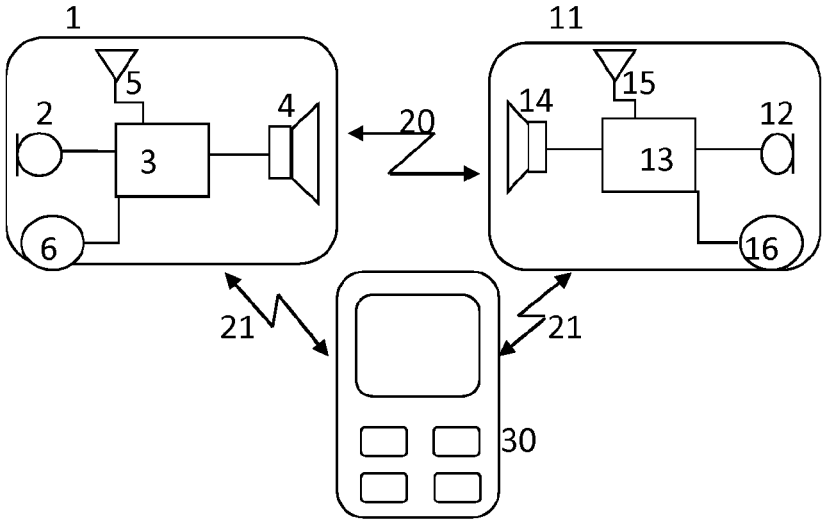
FIG. 1 shows a binaural hearing aid connected with a wireless link to a system according to an embodiment of the invention.

FIG. 1 shows two hearing aids 1, 11 each with a microphone 2, 12, a signal processor 3, 13, a receiver 4, 14, a diode 6, 16, an antenna 5, 15 and a wireless link 20 connecting the two hearing aids to form a binaural hearing aid system; The control unit 30 may be connected through wireless link 20 or act as a relay station through wireless links 21.

Figure 2:
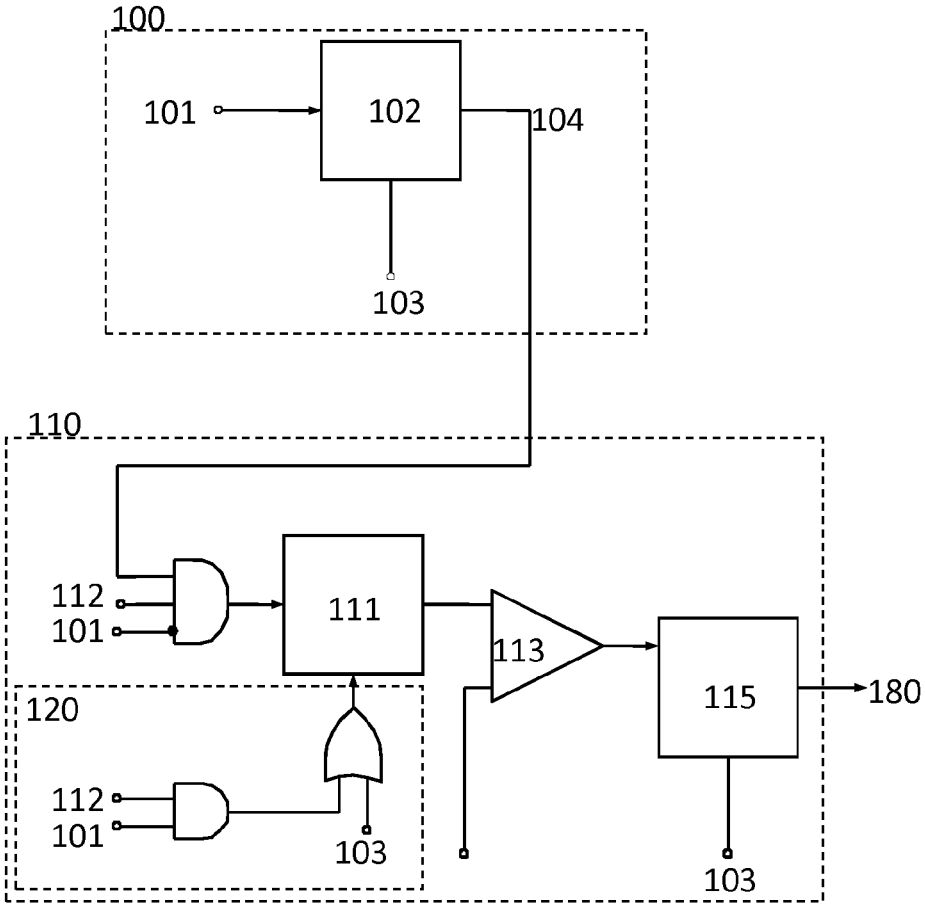
FIG. 2 shows a block diagram of a detection unit according to a first embodiment of the invention.

FIG. 2 shows a system adapted to detect whether there is an active connection to the opposite hearing aid, and, if there is no longer an active connection, give an alarm to the user of the hearing aid. A system like this is generally known as a watchdog. The wireless link activity detector 100 detects whether there is an active wireless connection. Terminal 101 is connected to the wireless link. As long as the wireless link receives data from the opposite hearing aid, the output 104 from the flip-flop or similar device 102 will confirm that the opposite hearing aid is present. Terminal 103 is a boot input to the flip-flop 102, to make sure that the initial state of 102 is correct after power-up. Block 110 is a dead time counter and comparator circuit. The output 180 from block 110 will trigger an alarm to the user if the wireless connection has been inactive for a preset amount of time. Box 111 is a dead time counter. Once the wireless link is no longer detecting an active connection to the opposite hearing aid, the dead time counter will start counting the clock cycles received through terminal 112. The circuit 120 is a reset circuit to reset the dead time counter 111, when the link has been reestablished. The comparator 113 will compare the number of clock cycles with a preset value. When the preset value of comparator 113 is reached, it will send a signal to 115 which will change the state of the output from "opposite hearing aid present" to "opposite hearing aid not present".

Figure 3:
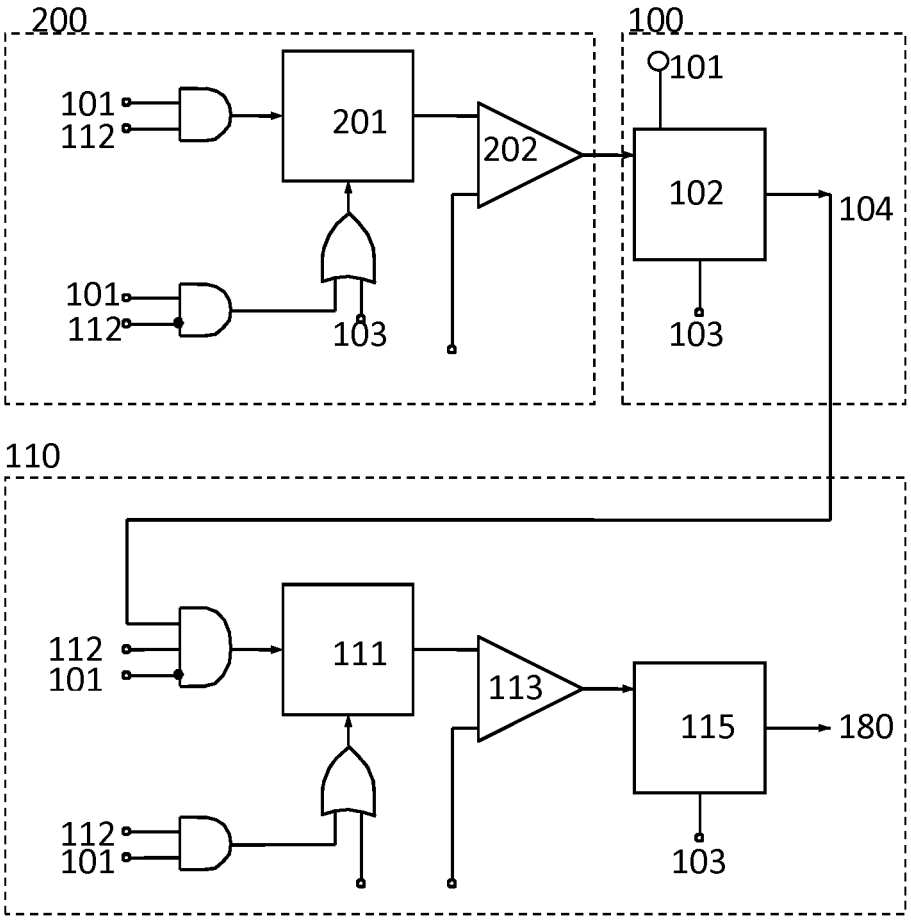
FIG. 3 shows a block diagram of a detection unit according to a second embodiment of the invention.

FIG. 3 shows the wireless link activity detector 100 and the dead time counter and comparator circuit 110 like in FIG. 2. Further FIG. 3 shows a circuit 200 that detects whether there has been an active wireless connection between the two hearing aids prior to the loss of connection. Circuit 200 is a live time counter and comparator circuit, with input 101 from the wireless link and input 112 from the clock, or a decimated version of the clock, to the counter 201. Similarly the live time counter may be reset through the boot terminal 103. This will be done for instance at start-up to ensure a correct initial state. Block 202 is a comparator, that compares the live time with a preset length of time before it triggers the dead time counter 102.

To ensure that an alarm is not triggered due to small interruptions in the connection, the system will include a counter and comparator to determine when the wireless link has been 'silent' for too long. The dead time accepted before alarm is set as convenient. Setting it too short may incur a risk of alarm at spurious interruptions of the link, setting it too long implies that a desired alarm may be delayed too much. Too long may be 10 to 20 seconds. One way to determine the time is to count the clock cycles and compare it with a number of clock cycles preset in the comparator.

If the connection between the two hearing aids is lost and is not reestablished within a period specified, the output of the detection system might enable a light emitting diode (LED) to start flashing on both hearing aids or play an audible message or send an alarm to the remote control, or other external unit. This will help the user locate the hearing aid if lost. If the connection is lost because of a flat battery on one hearing aid, the LED will only flash on the hearing aid still powered by the battery. This will be very helpful in order to determine which hearing aid has a flat battery, especially for people who need help from relatives or care takers to change their battery, as the hearing aid with a flat battery will not be flashing the LED. While the spoken message may stop after three messages the LED will keep flashing until the connection is reestablished or the hearing aids are disabled or the battery is flat. Disabling the LED and/or the audio alarm might be done by a constant press on the program switch for 5 seconds or similar input to the hearing aid or the remote control.

As some users may occasionally only wear a hearing aid in one ear, or may not want the alert feature, it is important to be able to turn the system on and off. This is preferably done with the appropriate fitting software at the initial fitting by the audiologist. The fitting software includes the option to enable or disable this feature of the hearing aid.

Further, it should be possible to set the number of times a message should be repeated and the interval by which the message should be repeated. The frequency of repeating the message may not be constant. One desirable way to repeat the message could be repeating the message at 2 minute intervals for the first three times, then repeating the message from 4 to 10 times at intervals of 10 minutes, and after that repeating the message at intervals of half an hour. Even though the audiologist has adjusted these settings according to the users wish, the user might still want to be able to control these settings himself or herself. This can be done by giving the hearing aid user a 'light' version of the fitting software, where he or she is able to adjust these settings at home at their own PC.

A problem sometimes arising with hearing aids during use is that a transducer stops working, partly or totally. This may occur because the transducer has been exposed to water or moist. While the transducers may be replaced, once the failure has been detected, it is not always easy for the user to identify the problem as it may arise slowly from just a slight degree of malfunctioning, barely audible to the user, to a severe degree of malfunctioning. If this happens over several weeks or months, the user might just think that it is due to a natural increase in his or her hearing loss. However it may be possible to measure this error in the transducer electrically. WO 2009006889 A1 teaches a way to identify whether it is the correct receiver attached to the hearing aid in a receiver-in-the-ear (RITE) type of hearing aid. Similarly, the impedance of a broken transducer may change and indicate that it is no longer working properly.

If the receiver of the first hearing aid is broken or malfunctioning, a message can be sent via the wireless connection to the second hearing aid, indicating a problem with the receiver and informing the user to seek professional assistance to solve the problem. Further EP 1276349 B1 teaches a way for the hearing aid itself to test parts of the hearing aid or the full function of the hearing aid.

Such a test may be triggered in one hearing aid. If it is not possible the alarm to user of a defect by the respective hearing aid, the alarm may be given in the opposite hearing aid.

We claim:

1. A hearing aid system comprising a first hearing aid and an external device, each having:

a short range communications component for establishing a short-range wireless link between the first hearing aid and the external device;

a monitor component to monitor whether the link is active; and an alert component to issue an alert based on the detection of no traffic at the link within a defined second period of time, following a first period of time with monitored active traffic on the link, said alert component making an activity determination when said monitor component indicates that said link has been active for a first period of time, and being responsive to said activity determination to issue said alert when said monitor component indicates that said link has been inactive for said second period of time;

wherein the alert component comprises: a first counter to count the clock cycles elapsed since the onset of traffic, a first comparator adapted to delay the start of active link detection until a first predetermined count is reached; a watchdog timer comprising a second counter adapted to count the clock cycles elapsed since the tripping by the first comparator, the watchdog timer having a second comparator to determine if a second predetermined count is reached; and alarm logic for issuing an alert when the second comparator indicates that the second predetermined count has been reached by the second counter.

2. The system according to claim 1, wherein said first hearing aid has a self-test component for conducting a self-test and a transmitter for sending a message on the link to said external device about the result of the self-test.

3. The system according to claim 1, wherein the alert component is adapted to issue an audible message or tone.

4. The system according to claim 1, wherein the alert component comprises a visual indicator.

5. The system according to claim 1, wherein the external device is a remote control.

6. The system according to claim 1, wherein said external device comprises a second hearing aid.

7. A method for notifying a user of a defect or error in a hearing aid system, comprising establishing a link for short range wireless connection between a first hearing aid and an external device, monitoring whether the link is active by, at each of said first hearing aid and external device:

starting a first counter once traffic has commenced; said first counter to count the clock cycles elapsed since the onset of traffic, adapting a first comparator to delay the start of active link detection until a first predetermined count is reached;

if the connection is not active, and the first counter has reached a first predetermined count, initiating a second counter; said second counter being part of a watchdog timer and adapted to count the clock cycles elapsed since the tripping by the first comparator; the watchdog timer having a second comparator to determine if a second predetermined count is reached;

if the connection is reestablished, resetting the second counter;

if the second counter reaches a second predetermined count, issuing an alert in at least said first hearing aid.

8. The method according to claim 7, wherein the alert is selected from a group consisting of a spoken message, a visual indicator, and a message sent to an external unit.

9. The method according to claim 7, wherein said external device comprises a remote control.

10. The method according to claim 7, wherein said external device comprises a second hearing aid.

* * * * *